US008272695B2

(12) United States Patent
King et al.

(10) Patent No.: US 8,272,695 B2
(45) Date of Patent: Sep. 25, 2012

(54) HINGE ASSEMBLY

(75) Inventors: David Russell King, Turrella (AU); Steven Leonard Higgs, Lane Cove (AU)

(73) Assignee: King Furniture (Australia) Pty Ltd. (AU)

( * ) Notice: Subject to any disclaimer, the term of this patent is extended or adjusted under 35 U.S.C. 154(b) by 132 days.

(21) Appl. No.: 12/904,206

(22) Filed: Oct. 14, 2010

(65) Prior Publication Data

US 2011/0140496 A1 Jun. 16, 2011

(30) Foreign Application Priority Data

Oct. 14, 2009 (AU) ..... 2009905005

(51) Int. Cl.

| | |
|---|---|
| ***A47C 7/38*** | (2006.01) |
| ***E05F 1/08*** | (2006.01) |
| ***E05F 1/12*** | (2006.01) |
| ***E05F 1/14*** | (2006.01) |
| ***E05D 11/08*** | (2006.01) |

(52) U.S. Cl. ..... 297/408; 16/307; 16/337; 16/342

(58) Field of Classification Search ..... 297/408; 16/386, 387, 277, 304, 305, 307, 319, 337, 16/342

See application file for complete search history.

(56) References Cited

U.S. PATENT DOCUMENTS

| | | | | |
|---|---|---|---|---|
| 5,010,983 | A * | 4/1991 | Kitamura | 16/342 X |
| 5,566,048 | A * | 10/1996 | Esterberg et al. | 16/307 X |
| 5,784,759 | A * | 7/1998 | King | 16/342 |
| 6,446,308 | B1 * | 9/2002 | Brewington et al. | 16/337 |

FOREIGN PATENT DOCUMENTS

WO WO-95/12735 5/1995

OTHER PUBLICATIONS

"International Application No. PCT/AU94/00669, International Search Report mailed Jan. 17, 1995", (Jan. 17, 1995), 3 pgs.

* cited by examiner

*Primary Examiner* — Rodney B White
(74) *Attorney, Agent, or Firm* — Schwegman Lundberg & Woessner, P.A.

(57) ABSTRACT

There is disclosed herein a hinge assembly comprising a mandrel having a longitudinal axis. A first arm is rotationally fixed relative to the mandrel and extends from one end of the mandrel generally transverse to the longitudinal axis. A second arm is rotatably connected relative to the mandrel about the longitudinal axis and extends from the opposite end of the mandrel generally transverse to the longitudinal axis. A coil spring is sleeved over and snugly surrounds the mandrel. Relative rotation of the first arm and the second arm in an opposite direction tightens the spring around the mandrel. Tightening of the spring generates resistance to relative rotation of the first arm and the second arm.

16 Claims, 3 Drawing Sheets

HINGE ASSEMBLY

The present application claims priority from Australian Provisional Patent Application No. 2009905005, dated Oct. 14, 2009, the content of which is incorporated herein by reference.

The present disclosure relates to a hinge assembly and in particular to a hinge assembly that provides relatively free movement in one direction of rotation while being relatively resistant to movement in an opposite direction of rotation.

Whilst there may well be many applications for such a hinge assembly, it finds a useful application in connecting a head rest for a chair back in a situation in which it is required to be able to set the head rest at any desired angle in relation to the back. Under these circumstances, it is desirable that the head rest shall be capable of being hinged forwardly in relation to the back relatively easily to a position in which it makes a desired angle with the back, but will resist the weight of a person sitting in the chair and leaning his head back against the head rest. However, the construction must be such as to permit the head rest to be hinged backwardly by the exertion of greater pressure.

The present applicant proposed such a hinge assembly in earlier International Patent Publication No. WO95/12735, the entire disclosure of which is incorporated herein by way of reference. However, this earlier hinge arrangement suffers from several drawbacks. In particular, the construction of the earlier hinge arrangement is such that the mounting flange (rear wall 12) for attaching the hinge arrangement to an article of furniture extends generally parallel with an axis of the mandrel and is spaced further from the axis of the mandrel than an outer diameter of the coil spring. Accordingly, a dimension of the hinge assembly transverse to the mandrel axis is undesirably increased. Also, the coil spring of the earlier hinge arrangement can undesirably catch on the mandrel at times when relatively free rotation of the hinge is desired. The construction of the earlier hinge arrangement is also such that it must be attached to an article of furniture, via the mounting flange (rear wall 12), with mechanical fasteners such as screws or bolts.

Any discussion of documents, acts, materials, devices, articles or the like which has been included in the present specification is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The present disclosure provides a hinge assembly comprising:

a mandrel having a longitudinal axis;

a first arm rotationally fixed relative to the mandrel and extending from the mandrel generally transverse to the longitudinal axis;

a second arm rotatably connected relative to the mandrel about the longitudinal axis and extending generally transverse to the longitudinal axis; and a coil spring sleeved over and snugly surrounding the mandrel, the coil spring being anchored with respect to the second arm, such that relative rotation of the first arm and the second arm in one direction loosens the spring around the mandrel to facilitate relative rotation of the first arm and the second arm, whereas relative rotation of the first arm and the second arm in an opposite direction tightens the spring around the mandrel to resist relative rotation of the first arm and the second arm.

The first arm may be located at one end of the mandrel and the second arm may be located at an opposite end of the mandrel.

The spring may have a non-circular cross-section. The cross-section of the spring may be angular, and, more specifically, may be rectangular in some embodiments.

An opening may be provided in the second arm, the opening extending generally transverse to a longitudinal axis of the second arm, and the mandrel may be engageable in the opening to rotationally connect the second arm relative to the mandrel. The opening may be provided in a collar provided at one end of the second arm. A clip may be connected to an end of the mandrel to captively retain the second arm on the mandrel.

The spring may be anchored with respect to the second arm by a projecting portion of the spring engaging a detent in the second arm.

A sleeve may be provided around the mandrel between the mandrel and the spring, the sleeve being elastically compressed by the spring into engagement with the mandrel upon relative rotation of the first arm and the second arm in said opposite direction. The sleeve may be a split sleeve having an axial opening to facilitate its compression by the spring.

The material properties and/or cross-section of the spring may be modified to tailor the rotational resistance of the hinge arrangement (e.g. lower friction spring materials and/or angular spring cross-sections can be used to reduce the rotational resistance of the hinge arrangement, and vice versa for higher friction spring materials and/or rounder spring cross-section. In embodiments using a sleeve between the mandrel and spring, the material properties of the sleeve may be selected to tailor the rotational resistance of the hinge arrangement.

In a second aspect, there is provided an article of furniture comprising:

a body; and a headrest hingedly connected to the body via a hinge assembly as defined in the first aspect above, one of the first arm and the second arm being connected to the body of the article of furniture and the other of the first arm and the second arm being connected to the headrest.

The first arm may be connected to the body of the article of furniture and the second arm may be connected to the headrest. The first arm may be welded to a frame of the body of the article of furniture. Alternatively, the first arm may be slidably engageable in openings in tubular members forming a frame of the body of the article of furniture.

The article of furniture may be a chair, and, more specifically, may be a lounge chair in some embodiments.

An embodiment of the subject hinge assembly will now be described, by way of example only, with reference to the accompanying drawings, in which.

Figure 1:
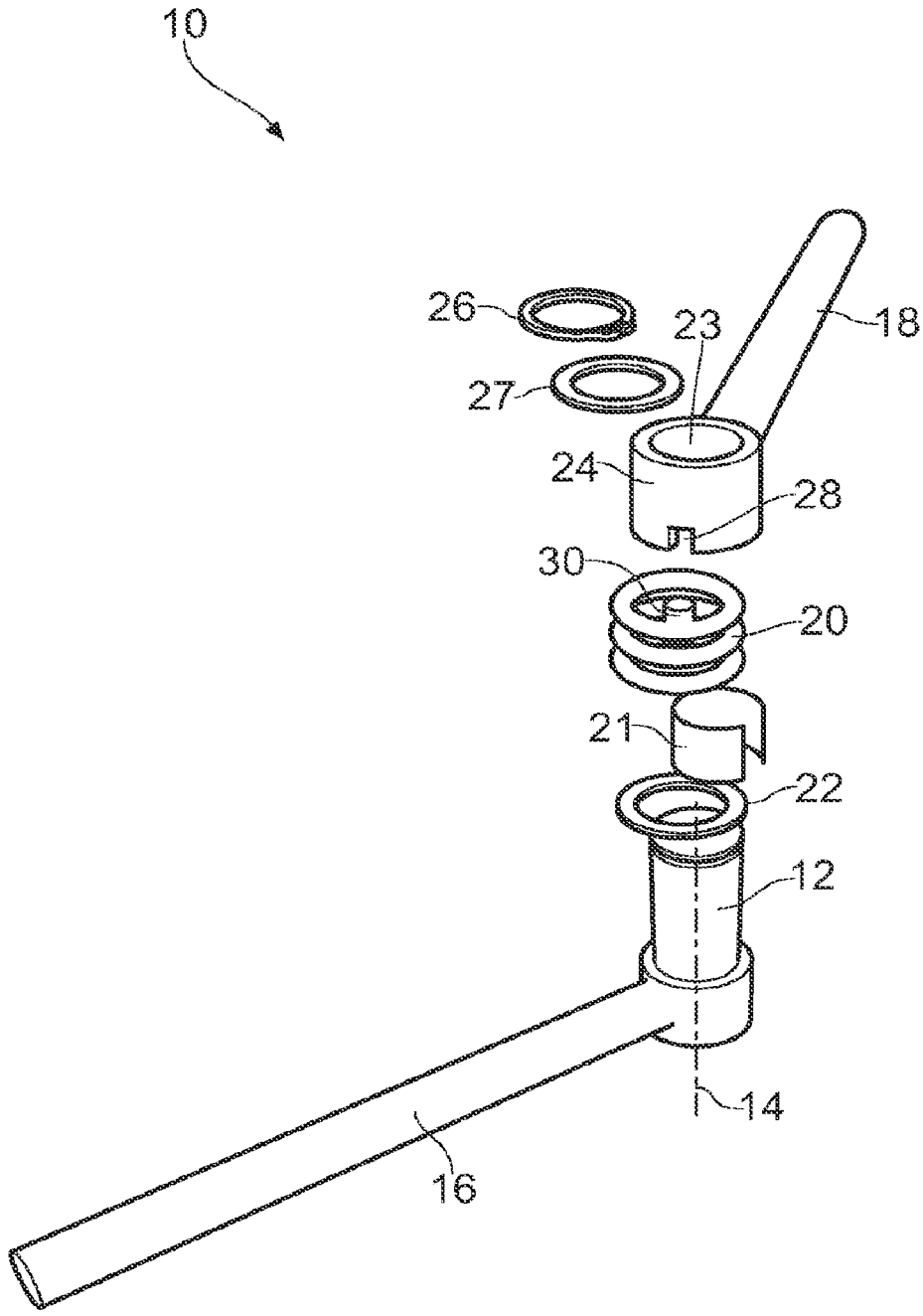
FIG. 1 is an exploded perspective view of an embodiment of a hinge assembly in accordance with the present disclosure.
Figure 2:
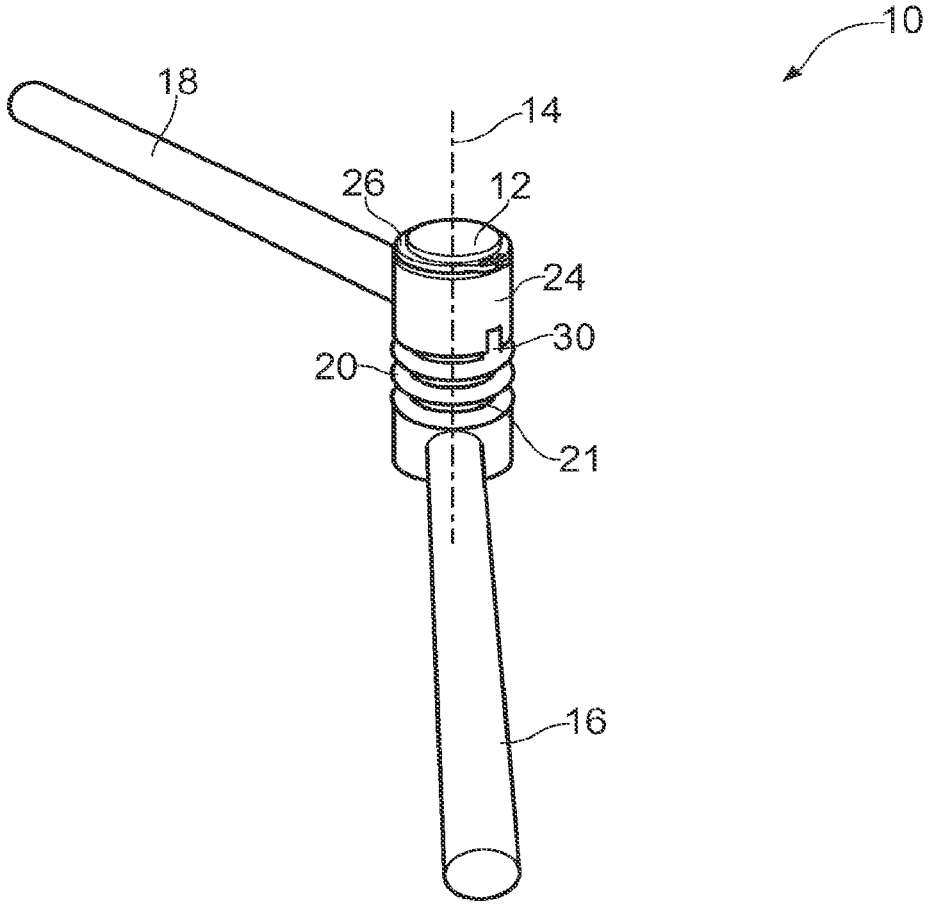
FIG. 2 is an assembled perspective view of the hinge assembly of FIG. 1.

Referring to the drawings, and in particular to FIGS. 1 and 2, there is shown a hinge assembly generally designated by reference numeral 10. The hinge assembly comprises a mandrel 12 having a longitudinal axis 14. A first arm 16 is rotationally fixed relative to the mandrel 12 and extends from one end of the mandrel 12 generally transverse to the longitudinal axis 14. A second arm 18 is rotatably connected relative to the mandrel 12 about the longitudinal axis 14 and extends from the opposite end of the mandrel 12 generally transverse to the longitudinal axis 14. A coil spring 20 is sleeved over and snugly surrounds the mandrel 12. Whilst a coil spring 20 of circular cross-section is shown in the drawings, a spring of rectangular cross-section is preferably used to reduce the contact area between the spring 20 and the mandrel 12 and thereby to reduce unwanted catching of the spring on the mandrel 12. When a spring 20 of circular cross section is used, as illustrated, a stainless steel split sleeve 21, having an axial opening to facilitate radial compression, is provided between the spring 20 and the mandrel 12 to inhibit the undesirable catching of the hinge assembly 10. A washer 22 separates the split sleeve 21 and spring 20 from the first arm 16. The spring 20 is oriented on the mandrel 12 such that its coils are clockwise when viewed in a direction from the first arm 16 toward the second arm 18. The coil spring 20 is anchored with respect to the second arm 18, such that relative rotation of the first arm 16 and the second arm 18 in one direction loosens the spring 20 around the mandrel 12 to facilitate relative rotation of the first arm 16 and the second arm 18. Relative rotation of the first arm 16 and the second arm 18 in an opposite direction tightens the spring 20 around the mandrel 12. As the spring 20 tightens, the sleeve 21 is elastically compressed by the spring 20 into engagement with the mandrel 12 to resist relative rotation of the first arm 16 and the second arm 18.

An opening 23 is provided in a collar 24 at one end of the second arm 18 and the mandrel 12 is engageable in the opening 23 to rotationally connect the second arm 18 relative to the mandrel 12. The opening 23 extends transverse to a longitudinal axis of the second arm 18. A circlip 26 is connected to an end of the mandrel 12 outboard of the collar 24 to captively retain the second arm 18 on the mandrel 12. A washer 27 is provided between the circlip 26 and the collar 24. The collar 24 has a detent 28 engageable by a projecting portion 30 of the spring 20 to anchor the spring 20 with respect to the second arm 18.

Figure 3:
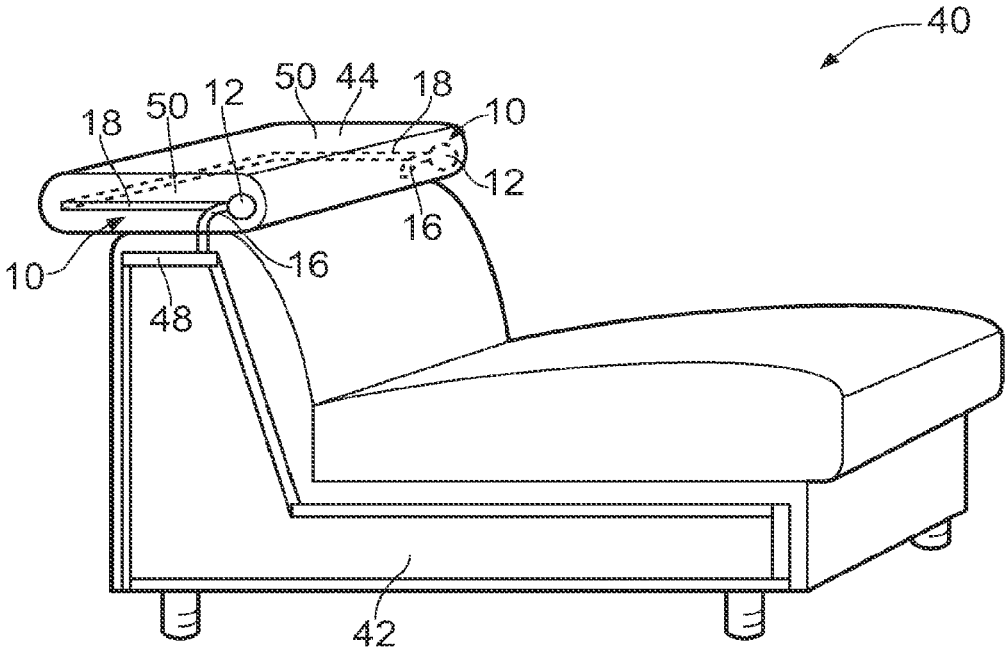
FIG. 3 is a schematic view of the hinge assembly of FIGS. 1 and 2 in use for connecting a headrest to a lounge chair.

FIG. 3 shows a lounge chair 40 comprising a body 42 and a headrest 44 hingedly connected to the body 42 via a slightly modified embodiment of the hinge assembly 10 as shown in FIGS. 1 and 2, in which the first arm 16 includes a bend. The first arm 16 of the hinge assembly is fixedly connected by welding to a tubular frame member 48 of the body of the chair and the second arm 18 extends into an opening 50 in the headrest 44. Accordingly, the first arm 16 is fixed to the chair body 42 and the second arm 18 is rotatable relative to the first arm 16 by rotating the headrest 44 relative to the chair body 42. Rearward rotation of the headrest 44 rotates the second arm 18 relative to the first arm 16, during which rotation engagement of the spring 20 with the detent 28 in the second arm 18 rotates the spring 20 against the mandrel 12 and friction between the mandrel 12 and the spring 20 acts to tighten the spring 20 about the mandrel 12 and increase rotational resistance of the hinge assembly 10. In contrast, forward rotation of the headrest 44 rotates the second arm 18 relative to the first arm 16, during which rotation engagement of the spring 20 with the detent 28 in the second arm 18 rotates the spring 20 against the mandrel 12 and friction between the mandrel 12 and the spring 20 acts to loosen the spring 20 about the mandrel 12 and reduce rotational resistance of the hinge assembly 10. When the headrest 44 is stationary, the spring 20 elastically returns to its natural state, in which the spring 20 snugly engages the mandrel 12. Due to the bend in the first arm 16, the mandrel 12 is located forwardly of the point of connection of the first arm 16 to the chair frame.

It will be appreciated that the illustrated hinge assembly 10 is relatively simple to install between two components to be hinged, as installation simply requires insertion of the first arm 16 into an opening in one of the components and insertion of the second arm 18 into the other component. Also, the use of a spring 20 of rectangular cross section reduces the tendency of the spring 20 to undesirably catch on the mandrel 12.

It will be appreciated by persons skilled in the art that numerous variations and/or modifications may be made to the specific embodiments described and illustrated without departing from the broad general scope of the present disclosure. The present embodiments are, therefore, to be considered in all respects as illustrative and not restrictive. Examples of possible variations and/or modifications include, but are not limited to:

- the material properties and/or cross-section of the spring 20 and/or sleeve 21 may be modified to tailor the rotational resistance of the hinge assembly (e.g. lower friction spring and/or sleeve materials and/or angular spring cross-sections can be used to reduce the rotational resistance of the hinge assembly, and vice versa for higher friction spring and/or sleeve materials and/or rounder spring cross-sections); and/or
- connecting the first arm 16 to the chair by slidably engaging the first arm 16 in openings in tubular members 48 of the chair frame.

What is claimed is:

1. A hinge assembly comprising:

a mandrel having a longitudinal axis;

a first arm rotationally fixed relative to the mandrel and extending from the mandrel generally transverse to the longitudinal axis;

a second arm rotatably connected relative to the mandrel about the longitudinal axis and extending generally transverse to the longitudinal axis; and a coil spring sleeved over and snugly surrounding the mandrel, the coil spring being anchored with respect to the second arm, such that relative rotation of the first arm and the second arm in one direction loosens the spring around the mandrel to facilitate relative rotation of the first arm and the second arm, whereas relative rotation of the first arm and the second arm in an opposite direction tightens the spring around the mandrel to resist relative rotation of the first arm and the second arm.

2. The hinge assembly according to claim 1, wherein the first arm is located at one end of the mandrel and the second arm is located at an opposite end of the mandrel.

3. The hinge assembly according to claim 1, wherein the spring has a non-circular cross-section.

4. The hinge assembly according to claim 3, wherein the cross-section of the spring is angular.

5. The hinge assembly according to claim 4, wherein the cross-section of the spring is rectangular.

6. The hinge assembly according to claim 1, further comprising an opening in the second arm, the opening extending generally transverse to a longitudinal axis of the second arm, wherein the mandrel is engageable in the opening to rotationally connect the second arm relative to the mandrel.

7. The hinge assembly according to claim 6, wherein the opening is provided in a collar provided at one end of the second arm.

8. The hinge assembly according to claim 1, further comprising a clip connected to an end of the mandrel to captively retain the second arm on the mandrel.

9. The hinge assembly according to claim 1, wherein the spring is anchored with respect to the second arm by a projecting portion of the spring engaging a detent in the second arm.

10. The hinge assembly according to claim 1, further comprising a sleeve extending around the mandrel between the mandrel and the spring, the sleeve being elastically compressed by the spring into engagement with the mandrel upon relative rotation of the first arm and the second arm in said opposite direction.

11. The hinge assembly according to claim 10, wherein the sleeve is a split sleeve having an axial opening to facilitate its compression by the spring.

12. The hinge assembly according to claim 10, wherein one or more material properties of the sleeve are selected to tailor a rotational resistance of the hinge assembly.

13. The hinge assembly according to claim 1, wherein at least one of, one or more material properties, and a cross-section of the spring, are modified to tailor a rotational resistance of the hinge assembly.

14. An article of furniture comprising:

a body; and a headrest hingedly connected to the body via a hinge assembly according to claim 1, one of a first arm and a second arm being connected to the body of the article of furniture and the other of the first arm and the second arm being connected to the headrest.

15. The article of furniture according to claim 14, wherein the first arm is connected to the body of the article of furniture and the second arm is connected to the headrest.

16. The article of furniture according to claim 14, wherein the article of furniture is a lounge chair.

* * * * *